United States Patent [19]

Lotz

[11] 3,950,961

[45] Apr. 20, 1976

[54] COOLING SYSTEM FOR A TWO-TEMPERATURE REFRIGERATOR

[75] Inventor: Helmut Lotz, Giengen, Germany

[73] Assignee: Bosch-Siemens Hausgerate GmbH, Munich, Germany

[22] Filed: Oct. 10, 1974

[21] Appl. No.: 513,938

[30] Foreign Application Priority Data

Oct. 11, 1973 Germany ..... 2350998

[52] U.S. Cl. ..... 62/149; 62/174; 62/198; 62/209; 62/526

[51] Int. Cl.[2] ..... F25B 45/00

[58] Field of Search ..... 62/149, 163, 174, 208, 62/209, 227, 509, DIG. 17, 198, 526

[56] References Cited

UNITED STATES PATENTS

| | | | |
|---|---|---|---|
| 2,581,044 | 1/1952 | Ratcliff | 62/149 |
| 2,828,614 | 4/1958 | Smith | 62/149 |
| 3,065,610 | 11/1962 | Maudlin | 62/149 |
| 3,238,737 | 3/1966 | Shrader et al. | 62/174 |

*Primary Examiner*—William F. O'Dea
*Assistant Examiner*—Ronald C. Capossela
*Attorney, Agent, or Firm*—Michael J. Striker

[57] ABSTRACT

A refrigerator has a low-temperature cooling compartment and a higher-temperature cooling compartment, and is provided with a cooling system comprised of a cooling-medium flow circuit. The flow circuit includes a compressor, a condenser downstream of the compressor, a flow restrictor downstream of the condenser, a first evaporator section downstream of the flow restrictor and operative for cooling the lower-temperature compartment, and a second evaporator section downstream of the first evaporator section and operative for cooling the higher-temperature compartment. An accumulator communicates with the flow circuit upstream of the flow restrictor. A heater is provided for heating liquid cooling medium in the accumulator to cause evaporation of part of such liquid cooling medium and concomitant pushing of the liquid remainder of the liquid cooling medium in the accumulator out of the accumulator and into the second evaporator section. A first regulator device controls the operation of the compressor and the energization of the heater in dependence upon the temperature of the higher-temperature compartment. A second regulator is operative independently of the operation of the first regulator for initiating operation of the compressor when the temperature of the lower-compartment exceeds a preselected maximum value.

11 Claims, 6 Drawing Figures

COOLING SYSTEM FOR A TWO-TEMPERATURE REFRIGERATOR

BACKGROUND OF THE INVENTION

The invention relates to refrigerators, and in particular to two-temperature refrigerators, provided with a single compressor cooling arrangement.

More particularly, the invention relates to refrigerators having a compressor-cooling arrangement whose cooling circuit, provided with a condenser, a flow restrictor and connecting conduits, has at least two evaporator sections arranged in the flow path of its cooling medium, with the first evaporator section being associated with a colder compartment and the second evaporator section being associated with a warmer compartment, further provided with a regulator device which intermittently turns the compressor on and off in dependence upon the temperature in the warmer compartment, with the regulator device turning on and off both the compressor current path and a heating element for an accumulator connected upstream of the flow restrictor, with turn-on of the accumulator heating element causing liquid cooling medium to be driven out of the accumulator and into the second evaporator section.

With refrigerators of this type it has been suggested to arrange in the cooling circuit between the condenser and the flow restricting arrangement, for example a capillary tube arrangement, a heatable accumulator provided with a heating element which is turned on simultaneously with the compressor, and from which, when the heating element is energized, cooling medium in liquid form is driven into the evaporator section associated with that cooling compartment which is maintained at the higher average temperature. This evaporator section is arranged in the flow path of the cooling medium downstream of the evaporator section associated with the lower-temperature cooling compartment. The operation of the compressor and of the heating element for the accumulator is controlled by means of a regulator provided with a sensor for sensing the temperature of the evaporator associated with the higher-temperature cooling compartment, with different circuit connections being made and broken in dependence upon the setting of the regulator. As a result of the heating of the accumulator, some of the cooling medium stored therein in liquid form evaporates and, due to the resulting volume increase the remaining liquid cooling medium is very suddenly expelled from the accumulator, thereby filling the evaporator of the warmer compartment with cooling medium in liquid form. In this way, the entire inherent cooling power is made available, both upon turning on of the compressor and upon heating of the evaporator associated with the warmer compartment.

Experience has indicated that a refrigerator provided with such a cooling system will operate in a trouble-free manner, so long as temperatures considerably below the freezing point are maintained in both refrigerator compartments, for example as is the case with freezer chests.

Attempts have been made to employ such refrigeration systems, which have been successfully used in freezer chests, in so-called two-temperature refrigerators. A two-temperature refrigerator is comprised of one compartment maintained at a temperature which is not to rise above the freezing point, and a second compartment which is maintained at a higher temperature; if the second compartment is provided with a fully automatic antifrost arrangement, then the temperature of the second compartment is to be maintained at a value just slightly above the freezing point. In particular, this is because the monitoring of the automatic defrosting of the higher-temperature compartment cannot be performed in a trouble-free manner, and in certain circumstances the temperature of the lower-temperature compartment rises above the highest permissible value. For a two-temperature refrigerator, it may for example be desired to maintain the temperature in the lower-temperature compartment always below −18° C during operation, while at the same time providing for the higher-temperature compartment a completely automatic antifrost defroster arrangement for the associated evaporator. When the known refrigeration system is employed, these temperature relationships cannot be reliably realized.

SUMMARY OF THE INVENTION

It is a general object of the invention to provide a low-temperature refrigeration system of the general type described above so designed that it can be successfully and reliably employed even in two-temperature refrigerators, such as of the type described above.

This object, and others which will become more understandable from the following description of a preferred embodiment, can be met, according to one advantageous concept of the invention, by providing the lower-temperature and higher-temperature refrigerator compartments with respective regulator devices, with the regulator device associated with the lower-temperature compartment being operative, when the temperature in that compartment exceeds a preselected maximum value, for turning on the compressor of the cooling system independently of the state of activation of the regulator device associated with the higher-temperature compartment. The provision of the regulator device associated with the lower-temperature compartment ensures in a simple manner that the maximum permissible temperature of the lower-temperature compartment, a temperature below the freezing point, will not be exceeded, even if unfavorable external factors come into play.

According to one advantageous concept of the invention, the regulator device associated with the warmer compartment is provided with a set of electrical contacts operative for causing an antifrost heater associated with the respective evaporator section to be turned on in alternation with the turning on of the compressor, and for causing a heating resistor for the accumulator to be turned on jointly with the compressor. This set of electrical contacts and the heating elements activated by the same assure that the evaporator section associated with the warmer compartment, at the end of each period of operation of the compressor, is quickly and reliably defrosted, and likewise assure that, when the regulator device provided with these electrical contacts initiates a new period of operation of the compressor, the evaporator section in question is quickly supplied with cooling medium in liquid form.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
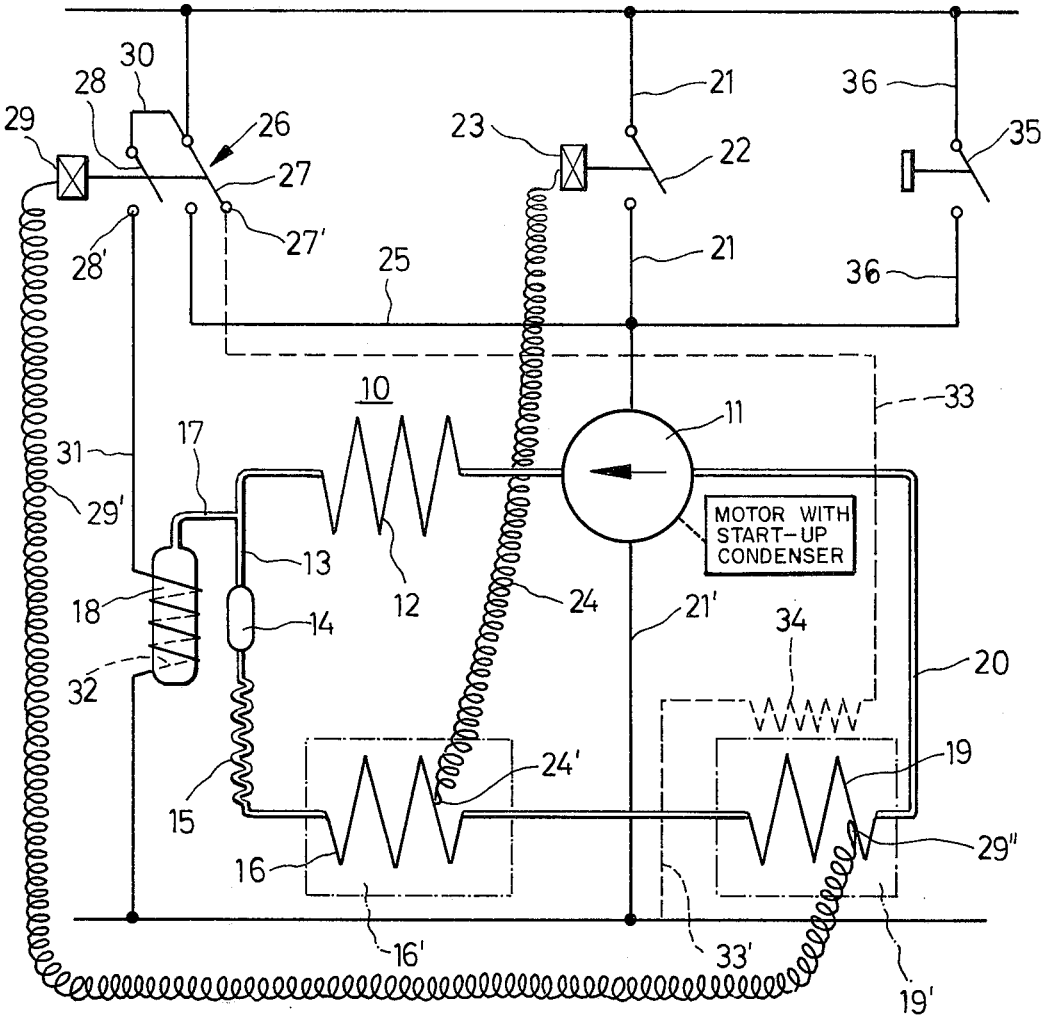
FIG. 1 depicts schematically a preferred cooling system according to the invention for use in a two-temperature-compartment refrigerator.

FIG. 1 depicts a cooling system generally designated by reference numeral 10. The cooling system 10 is employed in a non-illustrated two-temperature refrigerator, such as a refrigerator having a first compartment for perishables which are to be kept cool but not frozen and a second or freezer compartment for frozen foods. The cooling system 10, in conventional manner, is provided with an electromotor-driven compressor 11. Compressed cooling medium flows from the compressor 11 into a condenser 12 and from there, via a pressure conduit 13, a drier 14 and a capillary tube 15 arrangement serving as a flow restrictor, into a first evaporator section 16. The first evaporator section 16 is associated with the low-temperature compartment 16′ (schematically indicated by means of dash-dot lines) of the non-illustrated two-temperature refrigerator. An accumulator 18 is connected, by means of a branch-off conduit 17, to the portion of pressure conduit 13 intermediate the condenser 12 and the drier 14. (Further details concerning the connection and construction of the accumulator are described further below in connection with FIGS. 2*a–2d.*)

From the first evaporator section 16 for the low-temperature refrigerator compartment 16′, the cooling medium flows into a second evaporator section 19. The second evaporator section 19 is associated with the normal-temperature compartment 19′ (schematically indicated by means of dash-dot lines) of the non-illustrated two-temperature refrigerator. By way of a suction conduit 20, the cooling medium finally returns to the compressor 11.

The drive motor for the compressor 11 is connected, by means of conductors 21, 21′, to one phase and to the neutral conductor, respectively, of a current network. Connected in the conductor 21, which leads to the network phase line, is a moving switch member 22 actuated by a regulator 23. The regulator 23 detects the temperature of the first evaporator section 16, associated with the low-temperature cooling compartment 16′, by way of a sensor tube 24. The sensor tube 24 is connected at one end to the regulator 23, and is connected at its other end to a temperature sensor 24′ arranged in heat-exchanging relationship with the evaporator section 16. The regulator 23 is an ON-OFF regulator with adjustable threshold values dependent upon the regulator setting.

Connected in parallel to the switch 22, in a conductor 25, is a switch 26 provided with two moving switch members 27 and 28. The moving switch members 27, 28 are controlled by a regulator 29 which detects and operates in dependence upon the temperature of the second evaporator section 19, associated with the normal-temperature cooling compartment 19′. To this end, the regulator 29 is provided with a sensing tube 29′, one end of which is connected to regulator 29 and the other end of which is connected to a temperature sensor 29″ arranged in heat-exchanging relationship with the second evaporator section 19. The two moving switch members 27, 28 are connected by means of a bridging conductor 30 which is connected with the aforementioned current network phase line. Associated with the moving switch member 28 of the switch 26 is a stationary contact 28′, connected by means of a line 31 to the neutral conductor of the current network. Connected in the line 31 is a heating resistor 32 arranged in heat-exchanging contact with the accumulator 18. The switch 26, if necessary, can be provided with an additional stationary contact 27′, associated with the moving switch member 27, with a conductor 33 (shown in broken lines) leading from contact 27′ to defroster heating resistor 34 (also shown in broken lines). The defroster heating resistor 34 is arranged in heat-exchanging relationship with the second evaporator section 19, associated with the normal-temperature cooling compartment 19′, and is connected to the neutral conductor of the current network by means of a further conductor 33′ (also shown in broken lines). The illustrated cooling system further includes a fast-freeze switch 35, manually activatable whenever desired, and connected in a line 36 parallel to the switches 22, 26 controlled by the regulators 23, 29.

The regulators 23, 29 can be made responsive to either the temperature of the evaporator sections 16, 19 themselves or else can be made directly responsive to the temperature of the air in the compartments 16′, 19′.

FIGS. 2*a–2d* different constructions for the heatable accumulator 18, with corresponding parts in these four Figures being designated by the same reference numerals.

Figure 2:
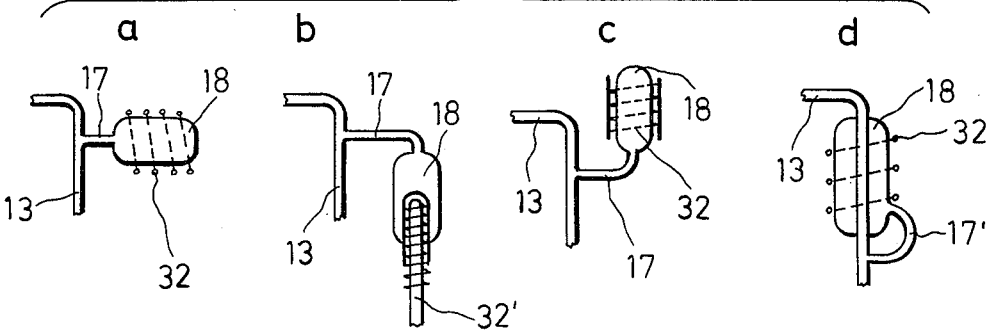
FIGS. 2*a–d* depict four different versions of a heatable accumulator for use in the cooling system of FIG. 1.
Figure 3:
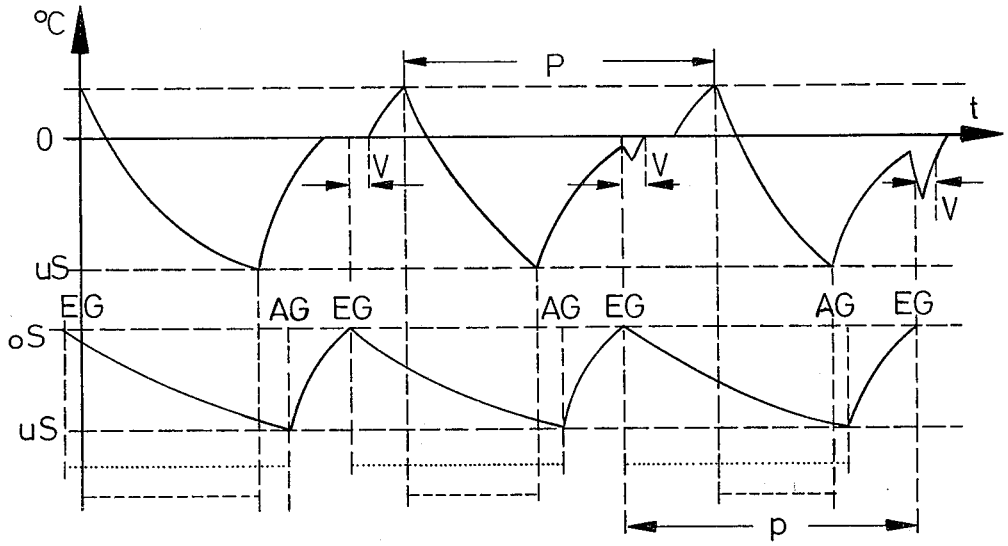
FIGS. 3–6 depict graphically the operation of the cooling system of FIG. 1 in four different circumstances.

The accumulator 18 of FIG. 2*a* is horizontally disposed, and is connected to the conduit 13 by means of the branch-off conduit 17. This accumulator is provided with a heating resistor having the form of a helical heating winding 32 wound around the body of the accumulator 18.

In FIG. 2*b*, the accumulator 18 is suspended from above, and is connected at its upper end to the aforementioned branch-off conduit 17. In this construction, use is made of a plug-like heater 32 which projects from below into a central recess in the accumulator 18.

In FIG. 2*c*, the accumulator 18 is supported from below, and is connected at its lower end to the branch-off conduit 17 leading to pressure conduit 13.

In FIG. 2*d* the accumulator 18 is constructed as a container which surrounds the pressure conduit 13 and which is connected to conduit 13 by means of an elbow-like branch-off conduit 17′. The accumulator of FIG. 2*d* is advantageously employed when the space in which it is to be accommodated is limited.

The volumetric capacity of the accumulator 18 is chosen such that the accumulator can accept the amount of cooling medium which occupies the evaporator section 19, under condensing pressure, during normal operation of the cooling system.

The illustrated system operates as follows:

Evaporated cooling medium is sucked through suction conduit 20 into the compressor 11 and there compressed, then conveyed into the condenser 12 where as a result of removal of heat it is transformed into its liquid phase. The liquid cooling medium then flows through the pressure conduit 13 and through the drier 14 into the capillary tube arrangement 15. Previous to this, a quantity of the liquid cooling medium corresponding approximately to the volumetric capacity of the cooling medium conduits in the second evaporator section 19 is pushed from the pressure conduit 13 through the branch-off conduit 17 into the heatable accumulator 18. After the liquid cooling medium in the capillary tube arrangement 15 is subjected to a vaporizing pressure decrease, it evaporates in the first evaporator section 16, associated with the refrigerator freezer compartment 16'. The cooling medium, now in the vaporized phase, passes through the second evaporator section 19, associated with the normal-temperature cooling compartment 19', and returns, via the suction conduit 20, and still in the vaporized phase, to the compressor 11.

During normal operation—i.e., when the fast-freeze switch 35 is open—the compressor is turned on as soon as either (1) the temperature of the evaporator section 16 of the freezer compartment 16' becomes so warm that the associated regulator 23 is triggered, causing the respective moving switch member 22 to complete the compressor current path 21, 21'; or (2) the temperature of the evaporator section 19 of the normal-temperature cooling compartment rises to a predetermined temperature (preferably +4°C) above freezing. In the latter case, when the regulator 29, set to a constant switch-on temperature of for example +4°C, becomes actuated, it causes the moving switch element 27 to complete a compressor current path 25, 21', and it causes the moving switch element 28 to complete the current path 31 for the heating resistor 32 associated with the accumulator 18. As a result, the heating resistor 32, which is supplied with only a low power of about 1 to 5 Watts and which accordingly has only a low heating capacity, maintains the accumulator 18 at a temperature higher than the cooling-medium condensation temperature, so that in the accumulator 18 there will be present vaporized cooling medium which is maintained at high pressure and only slightly superheated. The liquid cooling medium hitherto contained in the accumulator, whose volumetric capacity, as already stated, corresponds to the volumetric capacity of the cooling medium conduits in the second evaporator section 19, moves into the second evaporator section. The second evaporator section is accordingly full of liquid cooling medium and cools down quickly, as does the first evaporator section associated with the freezer compartment. The first evaporator section 16 associated with the freezer compartment 16, during the operation of the compressor 11, is continually filled with evaporating cooling medium, irrespective of whether the accumulator 18 is being heated. The cooling-down of the two evaporator sections 16, 19 lasts until one of the two sections 16, 19 reaches the turn-off temperature associated with the respective one of the two regulators 23, 29.

Depending upon whether the turn-off temperature of the regulator 23 or that of the regulator 29 is reached first, the operation of the cooling system will proceed in one of the ways graphically depicted in FIGS. 3–6, as follows:

1. The total duration (P) of the operating period in the normal-temperature refrigerator compartment is approximately equal to the total duration (*p*) of the operating period in the refrigerator freezer compartment (FIG. 3):

During the time intervals during which compressor 11 operates (indicated in FIGS. 3–6 by the dotted line segments), the switch-off temperature of regulator 29, associated with normal-temperature cooling compartment 19', is reached before the switch-off temperature of regulator 23 is reached. When the switch-off temperature of regulator 29 is thus reached, regulator 29 effects energization of the accumulator heating resistor 32 and establishes a closed current path for the compressor 11, via conductor 25. The time intervals during which heating resistor 32 is energized are indicated in FIGS. 3–6 by dashed line segments. However, the compressor 11 continues to operate, until the switch-off temperature of the regulator 23, associated with the refrigerator freezer compartment, is reached. As a result of the deenergization of the heating resistor 32, in consequence of the deactivation of regulator 29, the accumulator 18 cools down and becomes filled with liquid cooling medium from the pressure conduit 13. The liquid cooling medium still remaining in the second evaporator section 19 quickly evaporates, until the second evaporator section 19 is completely emptied of liquid cooling medium. The second evaporator section 19 begins to warm up, as a result of the transfer of heat from the goods and air present in the normal-temperature cooling comparment 19', or else as a result of energization of the defroster heater 34 by means of the moving switch member 27 of the regulator 29. Meanwhile, the evaporator section 16 associated with the freezer compartment 16' has likewise reached the switch-off temperature "uS" associated with its respective regulator 23. As a result, the regulator 23 opens the switch 22, thereby deenergizing the drive motor of compressor 11. Now the temperature of the first evaporator section 16, associated with the freezer compartment 16', likewise begins to increase, until eventually the point "EG" is reached, activating the regulator 23 which in turn closes switch 22 and thereby restarts operation of the drive motor of compressor 11. During the start-up of the compressor 11, a certain amount of liquid cooling medium will, for a brief time, be drawn through and evaporate in the second evaporator section 19, associated with the normal-temperature cooling compartment. This leads to a small delay in the warming of the second evaporator section 19, associated with the normal-temperature cooling compartment this recurring delay corresponding to the time intervals designated "V" in FIG. 3. Shortly after time "EG", the second evaporator section 19 reaches the switch-on temperature "oS" associated with the respective regulator 29, either as a result of transfer of heat from the goods and air contained in the freezer compartment, or else as a result of the operation of the defroster heater 34, which is provided to assure frost-free operation. Accordingly, the regulator 29 associated with the evaporator section 19 is activated and causes switch members 27, 28 to to assume positions respectively closing the current path 25, 21' of the compressor 11 and closing the current path 31 of the heating resistor 18 of the accumulator 18. Concomitantly, the switch member 27 moves out of engagement with contact 27, thereby interrupting the current path of defroster heater 34. This closing of the current path 25, 21' of the drive motor for the compressor 11, by means of the switch member 27, is at this point of no practical significance, since the compressor drive motor is already in energized condition, via the current path 21, 22, 21'. The energization of the heating resistor 32 causes the temperature of accumulator 18 to rise above the condensation temperature of the cooling medium. The cooling medium contained in the accumulator, which until this point was in liquid form, moves, in consequence of the vapor generation resulting from the heating action of component 32, again via evaporator section 16 into the evaporator section 19. The second evaporator section 19 becomes filled with the cooling medium which originates from the accumulator 18 and is depressurized upon passage through the capillary tube arrangement 15. This cooling medium evaporates inside evaporator section 19, thereby cooling the evaporator section 19.

This constitutes the end of a complete cycle of operation. The cycle of operation is continually repeated, and the temperatures in the freezer compartment and in the normal-temperature compartment fluctuate periodically about the constant average values set by means of the regulators 23 and 29.

Figure 4:
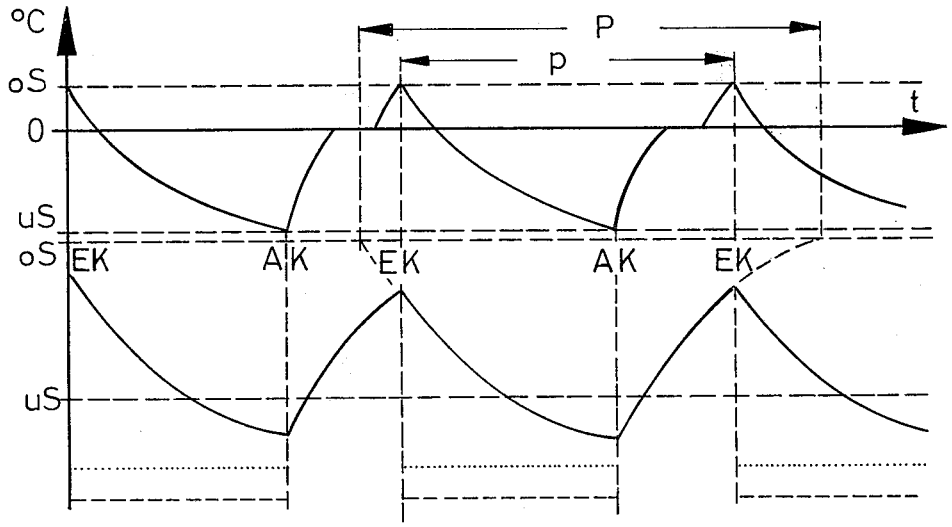
Figure 5:
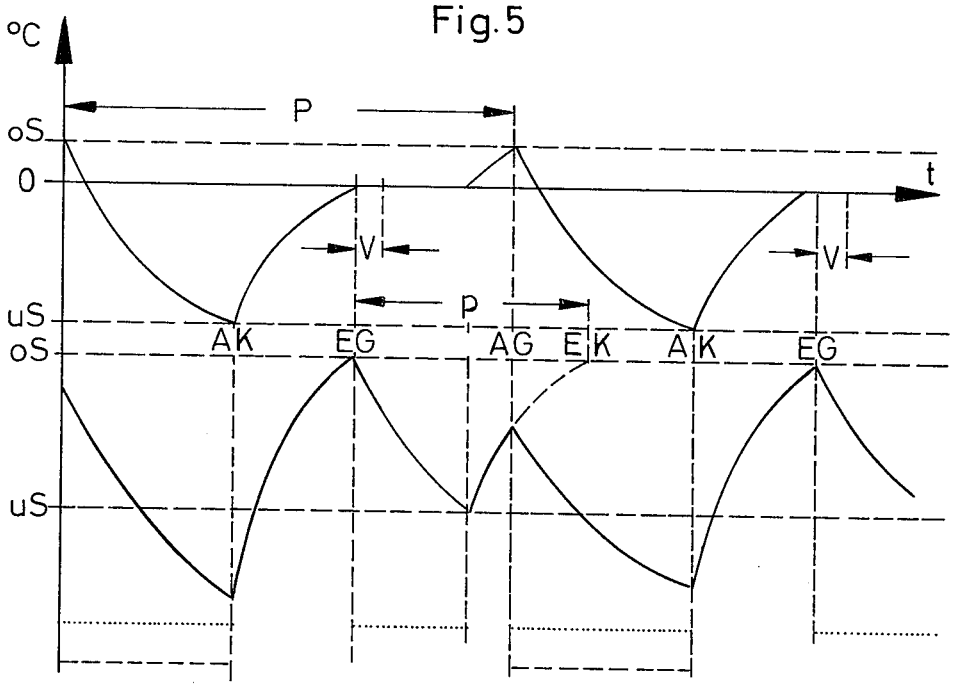
Figure 6:
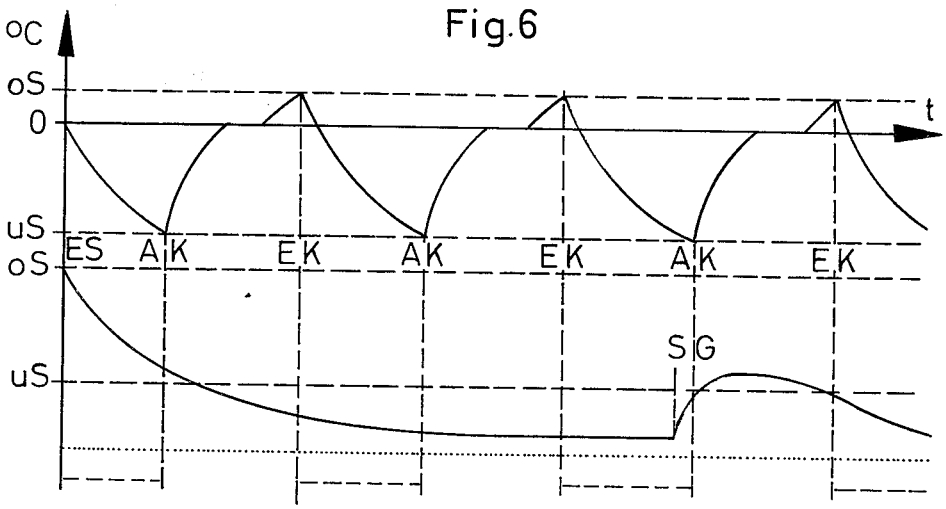

2. The total duration (P) of the operating period in the normal-temperature refrigerator compartment is smaller than the total duration (*p*) of the operating period in the freezer compartment of the refrigerator (FIG. 4):

The operating cycle in this case proceeds in a manner similar to that explained under (1) above. However, in this case, after the temperature of the first evaporator section 16 falls below the turn-off value associated with the regulator 23, further cooling of the second evaporator section 19, associated with the normal-temperature refrigerator compartment 19', is still required. Accordingly, the compressor 11 continues to operate until the switch-off time "AK" of regulator 29. As a result, the first evaporator section 16, associated with the freezer compartment 16', is cooled down to a lower temperature than necessary. Before the temperature of the first evaporator section 16 has reached the turn-on value "oS" associated with the regulator 23, the second evaporator section 19 has warmed up and become defrosted and has reached the switch-on temperature associated with regulator 29, regulator 29 becoming activated at time "EK", as shown in FIG. 4. The compressor 11 starts up, and the operation begins anew with the cooling down of the second evaporator section 19, with the temperature of the first evaporator section 16, associated with the freezer compartment 16', simultaneously decreasing.

A characteristic of the operating cycle described under (2) above is that the temperatures of the normal-temperature and freezer compartments of the refrigerator fluctuate periodically about constant average values, with the temperature of the freezer compartment periodically decreasing to values considerably below those corresponding to the setting of the associated regulator 23.

3. The total duration (P) of the operating period in the normal-temperature refrigerator compartment is greater than the total duration (*p*) of the operating period in the freezer compartment of the refrigerator (FIG. 5):

The operating cycle in this case again proceeds in a manner similar to that described under (1) above. Due to the prolonged operation of the compressor 11, under the control of the regulator 29 associated with the normal-temperature compartment 19, the first evaporator section 16, associated with the freezer compartment 16', cools down to a temperature far below its switch-off temperature "uS". However, after the second evaporator section 19, associated with the normal-temperature refrigerator compartment 19', is brought down to the switch-off temperature "uS" of the respective regulator 23, at time "AK", the evaporator section 19 then warms up quickly, so that by time "EG" the respective regulator 23 again turns on the compressor. The second evaporator section 19, after a delay indicated by the interval "V" in FIG. 5, thaws further, since the heating resistor 32 of the accumulator 18 is unenergized. Accordingly, the accumulator 18 is filled with liquid cooling medium, and in the evaporator section 19 no evaporation can occur. At time "AG" the switch-off temperature for the first evaporator section 16 is again reached, and the compressor 11 is turned off. Meanwhile, the second evaporator section 19 in the normal-temperature cooling compartment 19' has defrosted, so that when its temperature reaches the switch-on value "oS" of the respective regulator 29 at time "EK", the regulator 29 will become activated, thereby closing compressor-motor current path 25, 21' via switch member 27 and accordingly causing the compressor 11 to start up again. Simultaneously, by means of the switch member 28, the accumulator heater 32 is energized, so that the cooling medium contained in the accumulator will be pushed into the evaporator section 19. In this way, the first evaporator section 16, associated with the freezer compartment 16', although it has not yet warmed up to the switch-on temperature "oS" of the respective regulator 23, is again cooled down, just like the second evaporator section 19. Since the times "AG" and "EK", in unfavorable circumstances, may be so close to each other as to preclude the otherwise occuring pressure equalization, it may be necessary to provide suitable auxiliary start-up aids for the compressor (for example, a start-up condenser).

A feature of the operating cycle described under (3) above is that the temperature in the freezer compartment periodically sinks down to values lower than the switch-off temperature set on associated regulator 23. The freezer compartment temperature, subsequent to such drops, rises back to the preselected value, and the temperature in the normal-temperature cooling compartment 19' periodically fluctuates about the average value set on the respective regulator 29.

In view of the foregoing, it is desirable to select switch-on and switch-off temperatures for the regulators 23, 29 such that the total duration of the operating period in the normal-temperature cooling compartment is approximately equal to the total duration of the operating period in the freezer compartment. However, due to variations in the rate of warming up of the normal-temperature and/or freezer compartments, or due to one-sided shifts in the settings of the regulators, the operating cycle may at times take on the characteristics described under (2) or (3) above. However, this does not constitute a fundamental disadvantage; although the freezer-compartment temperature will at times drop too low, this will not do harm to the goods in the freezer compartment; in no case will the freezer-compartment temperature rise too high, and this is the important consideration since too high a freezer-compartment temperature would result in premature spoiling of the frozen perishables.

The operating cycle may also assume the characteristics described under (2) or (3) above as a result of irregular loading of the normal-temperature and freezer compartments, or as a result of irregular opening of the doors of the normal-temperature and freezer compartments. This can lead to a transient "mistuning" of the operating cycle; i.e., this can lead to a total duration (P) of the normal-temperature refrigerator compartment operating cycle which is either considerably greater or considerably less than the total duration (*p*) of the operating cycle in the freezer compartment. However, the cooling system "recovers" very quickly as soon as the unequal loading is discontinued, and the two durations P and *p*, defined above, quickly become approximately equal to each other.

4. Operation in response to activation of the fast-freeze switch 35 (FIG. 6):

When fast freezing is desired, in order to achieve maximum freezing power in the freezer compartment 16', the manually activatable switch 35 is closed. As a result, and irrespective of the settings of the two regulators 23, 29, the drive motor of the compressor 11 is turned on. As a result, the compressor 11 operates uninterruptedly. In the evaporator section 16 associated with the freezer compartment 16', uninterrupted evaporation of cooling medium occurs, resulting in maximum freezing power. This operation is graphically depicted in FIG. 6, in terms of the change with time of the surface temperature of the evaporator section 16. The closing of fast-freeze switch 35 occurs at time "ES". Due to the start-up of the compressor 11, the temperature in the freezer compartment 16' falls below the switch-off temperature "uS" of the respective regulator 23, down to the lowest temperature which the arrangement can reach. The rate at which the freezing occurs is dependent upon the quantity of goods to be froozen which are put into the freezer compartment 16' at time "ES".

If, with fast-freeze switch 35 still closed, additional goods to be frozen are introduced into the freezer compartment at time "SG" (see FIG. 6), the freezer compartment temperature will briefly rise and then drop back down to the minimum value. Independently of what occurs in the first evaporator section 16, the regulator 29 deenergizes the heating resistor 32 of the accumulator 18 at time "AK", i.e., as soon as the second evaporator section 19 in the normal-temperature cooling compartment 19' reaches the switch-off temperature of the respective regulator 29. The accumulator 18 fills with cooling medium, while simultaneously the residual liquid cooling medium is evaporated from the second evaporator section 19. Due to transfer of heat to the evaporator in the normal-temperature cooling compartment from the goods and air contained therein, or else due to the heating of the normal-temperature cooling compartment as a result of energization of the defroster heater 34, the normal-temperature cooling compartment warms up and accordingly defrosts until the switch-on temperature of the respective regulator 23 is reached at time "EK". At time "EK" the operating cycle for the second evaporator section 19 starts anew, without its being influenced by the uninterrupted evaporation of cooling medium taking place in the first evaporator section 16.

Thus, the temperature in the refrigerator compartment 19' will be uninfluenced by the temperature in the freezer compartment 16', and will be maintained at the preselected constant average value set on the respective regulator 29; the temperature in the freezer compartment, on the other hand, will assume the lowest possible value, which is dependent upon the rate of transfer of heat from the goods in the freezer compartment and from the surrounding environment, during uninterrupted operation of the compressor 11.

The maximum freezing power can be discontinued, by manually opening fast-freeze switch 35. Alternatively, however, the fast-freeze operation can be terminated automatically, either under the control of a conventional timing mechanism which is set into operation by the switch 35, or else when a preselected lowest temperature is reached.

It will be understood that each of the elements described above, or two or more together, may also find a useful application in other types of constructions differing from the types described above.

While the invention has been illustrated and described as embodied in a refrigerator having a normal-temperature compartment for foods which are not to be frozen and a freezer compartment for goods which are to be frozen, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a refrigerator having a lower-temperature cooling compartment and a higher-temperature cooling compartment, a cooling system, comprising, in combination, a circuit for the flow of cooling medium and including a compressor, a condenser downstream of said compressor, flow restrictor means downstream of said condenser, a first evaporator section downstream of said flow restrictor means and operative for cooling said lower-temperature compartment, and a second evaporator section downstream of said first evaporator section and operative for cooling said higher-temperature compartment; an accumulator communicating with said circuit upstream of said flow restrictor means; heating means for heating liquid cooling medium in said accumulator to cause evaporation of part of such liquid cooling medium and concomitant pushing of the liquid remainder of the liquid cooling medium in said accumulator out of said accumulator and into said second evaporator section; first regulator means operative for controlling the operation of said compressor and the energization of said heating means in dependence upon the temperature of said higher-temperature compartment; and second regulator means operative independently of the operation of said first regulator means for initiating operation of said compressor when the temperature of said lower-temperature compartment exceeds a preselected maximum value.

2. In a refrigerator as defined in claim 1, wherein said first regulator means comprises means for turning on said compressor and simultaneously energizing said heating means when the temperature of said higher-temperature compartment exceeds a preselected maximum value.

3. In a refrigerator as defined in claim 1, wherein said heating means constitutes first heating means, and further including second heating means operative for defrosting said higher-temperature compartment, wherein said first regulator means comprises switch means operative when the temperature of said higher-temperature compartment exceeds a predetermined value for deenergizing said second heating means, energizing said first heating means and initiating operation of said compressor and operative when the temperature of said higher-temperature compartment falls below a predetermined value for energizing said second heating means, deenergizing said first heating means and terminating operation of said compressor.

4. In a refrigerator as defined in claim 3, wherein said switch means comprises a plurality of electrical contacts connected in the circuits of said first heating means, of said second heating means and of said compressor.

5. In a refrigerator as defined in claim 3, wherein said switch means is an on-off regulator responsive to the temperature of air in said higher-temperature compartment.

6. In a refrigerator as defined in claim 1, wherein said heating means constitutes first heating means, and further including second heating means operative for defrosting said higher-temperature compartment, wherein said first regulator means comprises means operative when the temperature of said higher-temperature compartment exceeds a predetermined value for deenergizing said second heating means, energizing said first heating means and initiating operation of said compressor and operative when the temperature of said higher-temperature compartment falls below said predetermined value for energizing said second heating means, deenergizing said first heating means and terminating operation of said compressor.

7. In a refrigerator as defined in claim 1, wherein said first regulator means comprises means for turning on said compressor and energizing said heating means when the temperature of said higher-temperature compartment exceeds a preselected maximum temperature higher than 0°C.

8. In a refrigerator as defined in claim 1, wherein said compressor is provided with means for boosting the effect of said compressor during start-up of said compressor.

9. In a refrigerator as defined in claim 1, and further including fast freeze switch means operable at will for effecting uninterrupted operation of said compressor independently of the temperatures of said compartments.

10. In a refrigerator as defined in claim 1, and further including fast freeze switch means activatable at will for effecting uninterrupted operation of said compressor for a predetermined time interval.

11. In a refrigerator as defined in claim 1, and further including fast freeze switch means activatable at will for effecting uninterrupted operation of said compressor for a time interval dependent upon the temperature of said lower-temperature compartment.

* * * * *